US006166480A

United States Patent [19]

Ishida et al.

[11] Patent Number: 6,166,480

[45] Date of Patent: Dec. 26, 2000

[54] SPARK PLUG

[75] Inventors: Kenji Ishida, Nagoya; Yoshihiro Matsubara, Yokkaichi, both of Japan

[73] Assignee: NGK Spark Plug Co., Ltd., Aichi, Japan

[21] Appl. No.: 09/124,903

[22] Filed: Jul. 30, 1998

[30] Foreign Application Priority Data

Jul. 31, 1997 [JP] Japan ..... 9-220855

[51] Int. Cl.[7] ..... H01T 13/20; H01T 13/32

[52] U.S. Cl. ..... 313/141

[58] Field of Search ..... 313/141, 140, 313/144; 123/109 EL

[56] References Cited

U.S. PATENT DOCUMENTS 4,101,797 7/1978 Yamamoto .

FOREIGN PATENT DOCUMENTS

| | | | |
|---|---|---|---|
| 1009076A5 | 11/1996 | Belgium . | |
| 26 48 739 | 6/1977 | Germany | H01T 13/20 |
| 2648739 | 6/1977 | Germany | H01T 13/20 |
| 4406558A1 | 6/1977 | Germany | H01T 13/20 |
| 51-81835 | 6/1976 | Japan | H01T 13/32 |
| 53-48929 | 4/1978 | Japan | H01T 13/32 |
| 53-54774 | 5/1978 | Japan | F23Q 3/00 |
| 53-22657 | 6/1978 | Japan | H01T 13/30 |
| 60-142486 | 9/1985 | Japan | H01T 13/20 |
| 387080 | 2/1933 | United Kingdom | H01T 13/20 |
| 2 027 797 | 2/1980 | United Kingdom | H01T 13/20 |
| 2 184484 | 6/1987 | United Kingdom | H01T 13/20 |
| 2 189 545 | 10/1987 | United Kingdom | H01T 13/20 |

*Primary Examiner*—Ashok Patel

*Attorney, Agent, or Firm*—Snider & Associates; Ronald R. Snider

[57] ABSTRACT

A spark plug (1) comprises a center electrode (5), an insulator (3), a metallic shell (2), and a ground electrode (6). The center electrode (5) comprises a body portion (12) having a cylindrical peripheral surface and a front-end-side opposing face (11) opposed in generally parallel to a side face of the ground electrode (6), and a protruding portion (15) which is protruded from the front-end-side opposing face (11) at a position decentered toward one side opposite to the ground electrode (6) with respect to a center axis line of the body portion (12) and which has a top face (14) formed generally parallel to the side face of the ground electrode (6). Then, given a length D of a line segment formed by an intersection that an imaginary plane including the center axis line of the body portion (12) and a center axis line of the ground electrode (6) intersects the front-end-side opposing face (11), and a protruding height h to which the protruding portion (15) protrudes from the front-end-side opposing face (11), a value of h/D is set to not less than 0.2. As a result, mixed air can be smoothly fed to around a spark discharge gap g, and moreover the flame extinction phenomenon becomes unlikely to occur. Thus, a spark plug superior in ignitability can be realized.

27 Claims, 13 Drawing Sheets

A

B

SPARK PLUG

BACKGROUND OF THE INVENTION

The present invention relates to a spark plug to be used for internal combustion engines.

Conventionally, there has been known a spark plug 100 formed as shown in FIG. 17. In this spark plug 100, an insulator 102 and a metallic shell 103 are placed concentrically with each other outside a cylindrical center electrode 101, and one end of ground electrode 105 is connected to the metallic shell 103. The other end of the ground electrode 105 is bent sideways so that a front side face of the ground electrode 105 is opposed to a front end face of the center electrode 101, where a spark discharge gap g is formed between the ground electrode 105 and the center electrode 101. The spark plug 100 of such a structure is fitted to, for example, a cylinder head of an internal combustion engine so as to be used as an ignition source for mixed air fed to the combustion chamber.

In order that the air-fuel mixture within the engine cylinder is ignited by using the spark plug 100 and thus burned, it is important not only to securely ignite the air-fuel mixture at near the spark discharge gap g but also to promptly propagate the flame from a pilot burner to the air-fuel mixture within the cylinder. For this purpose, the air-fuel mixture must be smoothly fed to around the spark discharge gap g, whereas the ground electrode 105 presents beside the center electrode 101 is likely to be obstructive to the air-fuel mixture flow or the flame propagation. For example, if a space K formed beside the center electrode 101 with the ground electrode 105 is too small, the air-fuel mixture would less flow into the space K, which could cause an obstacle for the ignition. Also, too small a space K would hinder the outflow of the flame generated by the ignition, which would make it more likely to occur that heat is deprived by the contact with the ground electrode 105 to hinder the flame propagation, i.e. a flame quenching effect. These phenomena can make a cause of deterioration in the ignitability of the spark plug.

SUMMARY OF THE INVENTION

An object of the present invention is to provide a spark plug which allows the air-fuel mixture to be smoothly fed to around the spark discharge gap so that the flame quenching effect is less likely to occur and moreover which is superior in ignitability.

According to the present invention, there is provided a spark plug comprising as its main part: a center electrode; an insulator provided outside the center electrode; a metallic shell provided outside the insulator; and a ground electrode which is so arranged that one end is coupled to the metallic shell and the other end is folded back sideways so as to be opposed to the center electrode so that a side face of the ground electrode is opposed to a front end portion of the center electrode. The center electrode comprises: a body portion having a cylindrical peripheral surface and a front-end-side opposing face opposed and generally parallel to the side face of the ground electrode; and a protruding portion which protrudes from the front-end-side opposing face at a position off-center with respect to a center axis line of the body portion toward one side opposite to the ground electrode and which has a top face formed generally parallel to the side face of the ground electrode.

The protruding portion formed in the front end side opposing face of the center electrode is off-center with respect to the center axis line of the body portion toward a side opposite to the ground electrode. Thus, the space formed beside the center electrode against the ground electrode is enlarged, allowing the mixed air to smoothly flow into the space. Also, the enlarged space makes it unlikely that the flame generated by an ignition is hindered from flowing out, and an increased distance between the flame and the ground electrode reduces the effect of flame extinction due to the ground electrode. As a result of these, the ignitability of the spark plug can be greatly improved.

In the constitution of the spark plug of the present invention, given a length D of a line segment formed by an intersection that an imaginary plane including the center axis line of the body portion and a center axis line of the ground electrode intersects the front-end-side opposing face, and a protruding height h to which the protruding portion protrudes from the front-end-side opposing face, a value of h/D is preferably set to not less than 0.2.

If the h/D is less than 0.2, it may become more likely that the outflow of the flame generated by the inflow of air-fuel mixture to the space or by the ignition is hindered by the ground electrode, so that a sufficient effect of ignitability improvement of the spark plug may not be achieved. The value of h/D is more preferably adjusted so as to be not less than 0.3. In addition, the upper limit for h/D is set, as required, within a such range that a specified mechanical strength is ensured in order that the protruding portion, upon application of a force sideways to the protruding portion, will not yield any bending or break or the like.

On the other hand, in the spark plug of the present invention, given a volume $V_1$, of a portion surrounded by a plane including the front-end-side opposing face of the body portion, a plane including a top face of the protruding portion, and an extension of the peripheral surface of the front-end-side opposing face toward the protruding portion, and a volume $V_2$ of the protruding portion, a value of $V_2/V_1$, is preferably not more than 0.8.

If the $V_2/V_1$, exceeds 0.8, it may become more likely that the outflow of the flame generated by the inflow of air-fuel mixture to the space or by the ignition is hindered by the ground electrode, so that a sufficient effect of ignitability improvement of the spark plug may not be achieved. The value of $V_2/V_1$, is desirably adjusted so as to be not more than 0.5. In addition, the lower limit for $V_2/V_1$ is set, as required, within a such range that a specified mechanical strength is ensured in order that the protruding portion, upon application of a force sideways to the protruding portion, will not yield any bending or break or the like.

In addition, in the spark plug of the constitution above, if the value of h/D is set to not less than 0.2 where D is the length of the line segment formed by an intersection that an imaginary plane including the center axis line of the body portion and the center axis line of the ground electrode intersects the front-end-side opposing face and h is the protruding height of the protruding portion from the top face, then the ignitability of the spark plug can be further improved.

For the spark plug of the present invention, it is more preferable that the degree of decentering of the protruding portion formed on the front-end-side opposing face of the center electrode is set as shown below. That is, on condition that an imaginary plane that intersects a plane including the center axis line of the body portion and the center axis line is set so that an intersecting line coincides with the center axis line of the body portion, and that a region farther from the ground electrode out of two regions of the front-end-side opposing face divided by the plane is taken as a reference region, when the top face of the protruding portion and the front-end-side opposing face are viewed in a direction perpendicular to these surfaces, an area of a portion overlapping between the top face and the reference region is represented as $S_1$ and an area of the top face is represented as $S_2$, then a value of $S_1/S_2$ is set not less than 0.7. By setting the $S_1/S_2$ to not less than 0.7, a space can be formed beside the center electrode against the ground electrode more effectively so that the ignitability of the spark plug can be further improved. The value of $S_1/S_2$ is, more desirably, about 1.0.

Also, the axial cross section of the ground electrode may be so shaped as to be reduced in width on one side facing the center electrode than on its opposite side. With such a shape of the axial cross section of the ground electrode, when the air-fuel mixture is fed sideways, the resistance of the ground electrode to the inflow of the air-fuel mixture can be reduced and moreover a smoother inflow of the air-fuel mixture to the space can be obtained, so that the ignitability of the spark plug can be further improved. Meanwhile, the ground electrode may have a reduced-width portion formed in a range from a specified intermediate position in its longitudinal direction, the reduced-width portion being reduced in width on a base end side of the ground electrode more than on its front end side. In this case, the inflow of air-fuel mixture directed from the front end side of the ground electrode toward the spark discharge gap is smoothed so that the ignitability of the spark plug can be improved likewise. Also, by forming the cross section of the ground electrode into a shape as described above, or by forming the width-reduced portion, the volume of the ground electrode is reduced so that the head generated due to the ignition is less lost. Thus, the effect for reduction in the flame quenching can be expected.

Further, the spark plug of the present invention may be so arranged that a chip made from metal, or composite material composed principally of metal, whose main component is at least any one of Ru, Rh, Pd, Os, Ir and Pt is fixed to at least one of the top face of the protruding portion of the center electrode and the side face of the ground electrode. The fixed chip functions as an igniter for forming a spark discharge gap of the spark plug. The material for forming the chip, i.e. the igniter, is superior in both heat resistance and corrosion resistance, which suppresses the wear of the igniter, so that the durability of the spark plug can be improved.

For example, the alloy for forming the chip may be composed of a noble metal alloy composed principally of one kind or two or more kinds selected out of Ir, Pt, and Rh. When a Pt based alloy is used, Pt—Ni alloy (e.g., Pt and 1–30 wt % Ni alloy) can suitably used. Further, as those composed principally of Ir, the following ones may be used:

(1) An alloy containing Ir as the major component and 3–50 wt % of Rh (where not including 50 wt %) is used. Use of this alloy suppresses the wear of the igniter due to oxidation and volatilization of the Ir component at high temperatures so that a spark plug superior in durability can be realized.

If the content of Rh in the alloy becomes less than 3 wt %, then the oxidation and volatilization suppressing effect of Ir may become insufficient, making the igniter more liable to wear, resulting in deteriorated durability of the plug. Meanwhile, if the content of Rh becomes 50 wt % or more, the melting point of the alloy lowers so that the durability of the plug may deteriorate as well. From these facts, the content of Rh is preferably adjusted within the aforementioned range, desirably a range of 7–30 wt %, more desirably 15–25 wt %, and most desirably 18–22 wt %.

(2) An alloy containing Ir as the major component and 1–20 wt % of Pt. Use of this alloy suppresses the wear of the igniter due to oxidation and volatilization of the Ir component at high temperatures so that a spark plug superior in durability can be realized. In addition, if the content of Pt in the alloy becomes less than 1 wt %, then the oxidation and volatilization suppressing effect of Ir may become insufficient, making the igniter more liable to wear, resulting in deteriorated durability of the plug. Meanwhile, if the content of Pt becomes 20 wt % or more, the melting point of the alloy lowers so that the durability of the plug may deteriorate as well.

The material for forming the chip (igniter) may contain oxides (including composite oxides) of metallic elements belonging to the 3A group (so-called rare earth elements) and the 4A group (Ti, Zr, Hf) of the element periodic table at a ratio within a range of 0.1–15 wt %. As a result of this, the wear due to oxidation and volatilization of the Ir component can be suppressed more effectively. In this case, because the oxidation and volatilization of the Ir component can be suppressed by blending the oxide, metallic part constituting the chip may be formed from an Ir single-substance metal other than Ir alloys such as shown in the above (1) and (2). In addition, if the content of the oxide becomes less than 0.1 wt %, the oxidation volatilization preventing effect of Ir by the addition of the oxide can no longer be obtained. Meanwhile, if the content of the oxide exceeds 15 wt %, the thermal shock-resistance properties of the chip lowers, which may cause such malfunctions as cracking in the fixing of the chip by welding or the like. Furthermore, as this oxide, $Y_2O_3$ can suitably be used and, besides, $La_2O_3$, $ThO_2$, $ZrO_2$ and the like may also be preferably used.

DETAILED DESCRIPTION OF THE PREFERRED EMBODIMENTS

Herein below, embodiments of the present invention are described with reference to the accompanying drawings.

Figure 1A:
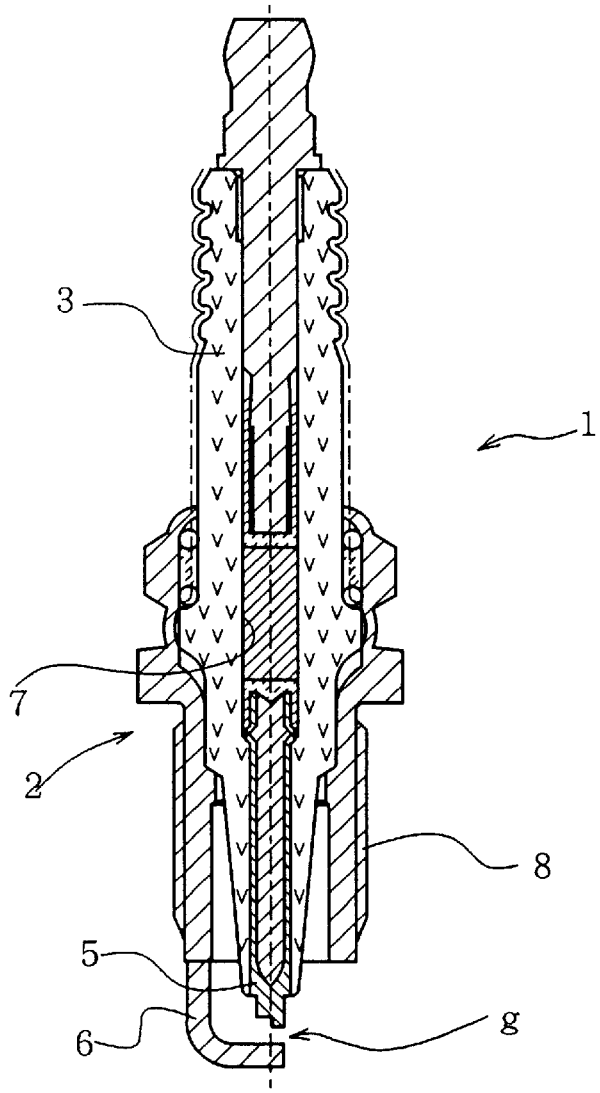
FIG. 1A is a longitudinal sectional view showing a spark plug of the present invention.
Figure 1B:
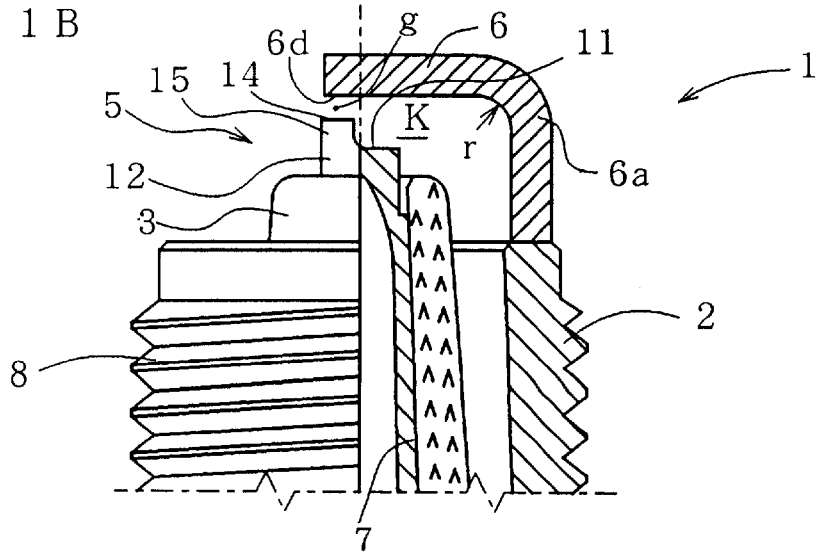
FIG. 1B is an enlarged sectional view of main part of the spark plug.
Figure 2:
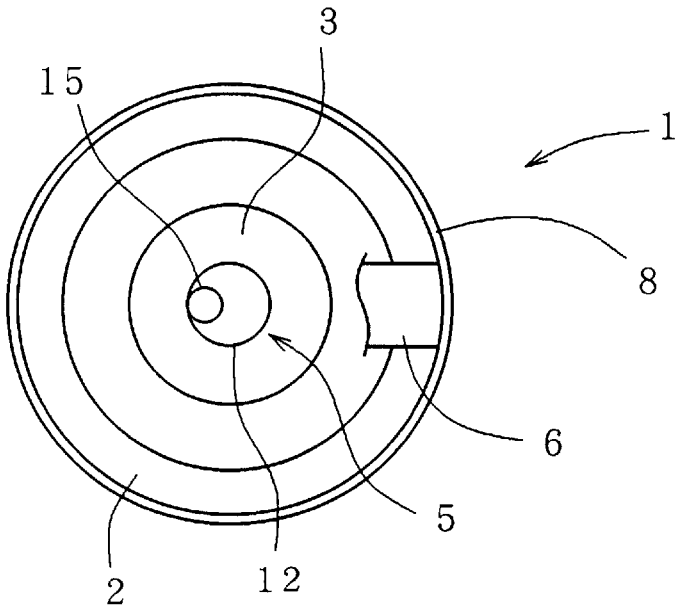
FIG. 2 is a plan view of FIG. 1B.

A spark plug 1 as shown in FIGS. 1A and 1B, which is an embodiment of the present invention, comprises a cylindrical metallic shell 2, an insulator 3 fitted inside the metallic shell 2 so that a front end of the insulator 3 is protruded from the metallic shell 2, a center electrode 5 provided inside the insulator 3 with a front end portion of the center electrode 5 exposed, a ground electrode 6 one end of which is coupled to the metallic shell 2 by welding or the like and the other end of which is bent sideways at a bent portion 6*a* so that a side face 6*d* of the ground electrode 6 is opposed to the front end portion of the center electrode 5, and the like.

The insulator 3 is made of a ceramic sintered body such as alumina or aluminum nitride, and has, in its interior, a holed portion 7 for fitting the center electrode 5 therein along the axial direction of the insulator 3. Also, the metallic shell 2 is formed into a cylindrical shape from low carbon steel or other metal so as to serve as a housing for the spark plug 1, and a threaded portion 8 for mounting the spark plug 1 to an unshown engine block is formed in the peripheral surface of the metallic shell 2.

Figure 3:
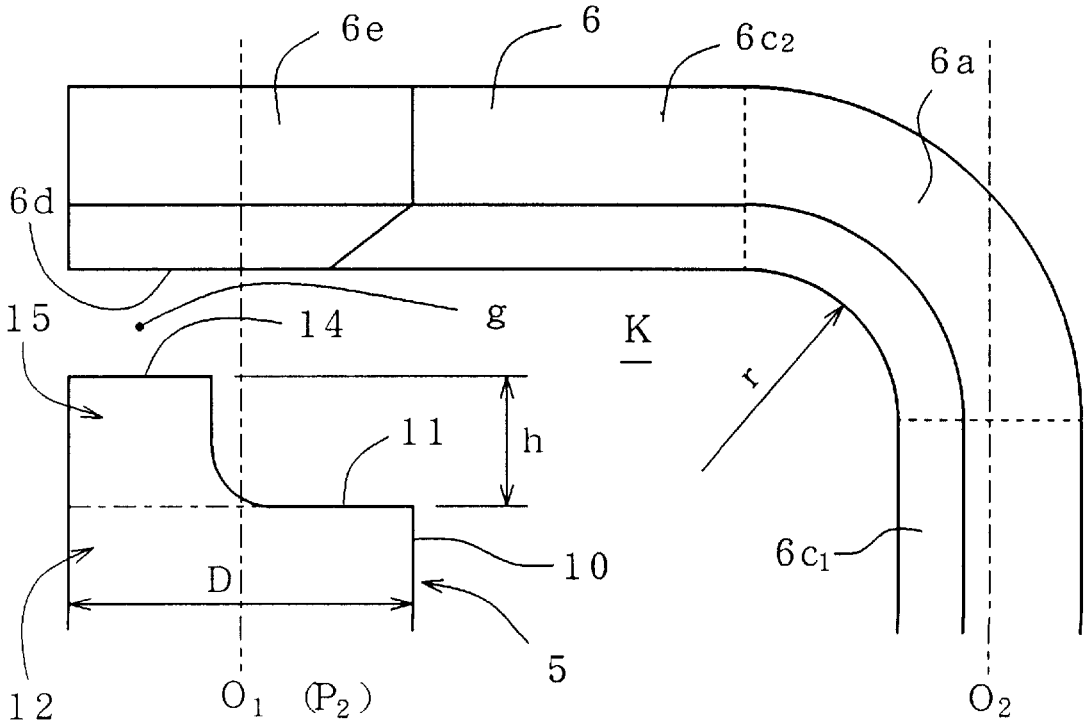
FIG. 3 is a partly enlarged view of FIG. 1.

The center electrode 5 is made from Ni alloy or the like, and has, as shown in FIG. 3, a cylindrical peripheral surface 10, a body portion 12 having a front-end-side opposing face 11 opposed in generally parallel to the side face 6*d* of the ground electrode 6, and a protruding portion 15 protruding from the front-end-side opposing face 11 at a position decentered toward a side opposite to a center axis line $O_2$ of the ground electrode 6 with respect to a center axis line $O_1$ of the body portion 12. The protruding portion 15 has an axial cross section of, for example, a circular shape, in which its top face 14 and the side face 6*d* of the ground electrode 6 are formed so as to be generally parallel to each other and a gap between the top face 14 and the side face 6*d* is defined as a spark discharge gap g. In addition, the ground electrode 6 is so formed that a linear portion formed into a rectangular cylinder is connected to at least one end side of the bent portion 6*a*, and the center axis line $O_2$ is defined as a line obtained by connecting geometric centroid positions of axial cross sections of the linear portion $6c_1$ of the rectangular cylinder with each other. In this embodiment, the ground electrode 6 comprises a first linear portion $6c_1$, formed on the base end side so as to be generally parallel to the center axis line $O_1$ of the body portion 12 of the center electrode 5, a second linear portion $6c_2$ formed on the front end side so as to be generally parallel to the front-end-side opposing face 11 of the center electrode 5, and the bent portion 6*a* with which those first and second linear portions $6c_1$, $6c_2$ are connected to each other.

Figure 4A:
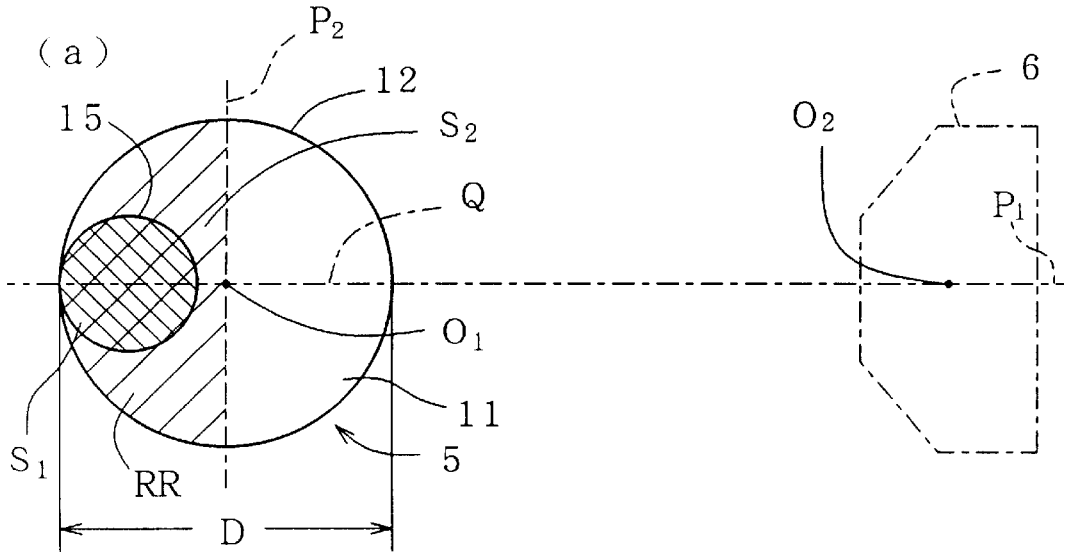
FIG. 4A is a plan view of FIG. 3.
Figure 4B:
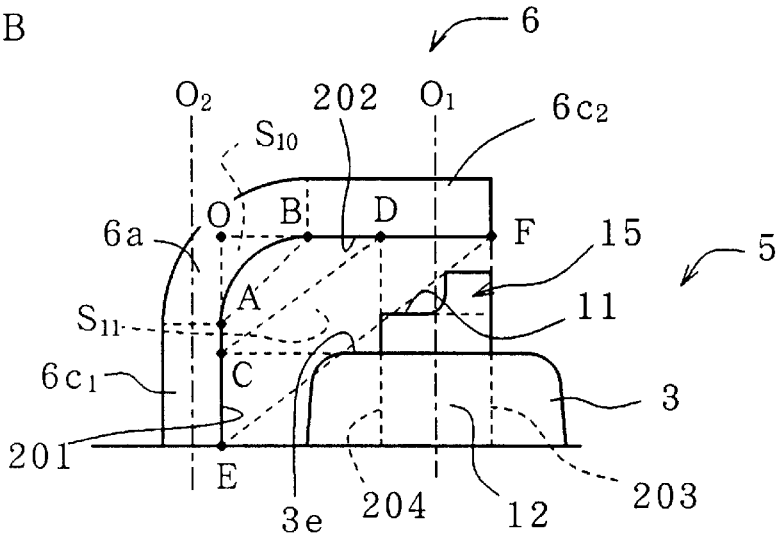
FIG. 4B is a schematic side view of FIG. 3.

Next, as shown in FIGS. 3, 4A and 4B, in the center electrode 5, if the length of a line segment Q formed when an imaginary plane $P_1$, including the center axis line $O_1$ of the body portion 12 and the center axis line $O_2$ of the ground electrode 6 intersects the front-end-side opposing face 11 is represented as D, and if the protruding height of the protruding portion 15 from the front-end-side opposing face 11 is represented as h, then the value of h/D is set to not less than 0.2 (desirably not less than 0.3).

Also, the degree of decentering of the protruding portion 15 formed on the front-end-side opposing face 11 is set as follows. That is, as shown in FIG. 4A, if a plane P2 that intersects the plane P1 is set so that its intersecting line coincides with the center axis line $O_1$, and if a region farther from the ground electrode 6 out of two regions of the front-end-side opposing face 11 divided by the plane P2 is represented as a reference region RR, and if the area of a portion that overlaps the reference region RR out of the top face 14 of the protruding portion 15 is represented as $S_1$ and the area of the top face 14 is represented as $S_2$, then the value of $S_1/S_2$ is set to not less than 0.7 (desirably not less than 1.0). In addition, this embodiment shows a case where the value of $S_1/S_2$ is set to 1, i.e., a case where the whole top face 14 of the protruding portion 15 overlaps the reference region RR).

Figure 5:
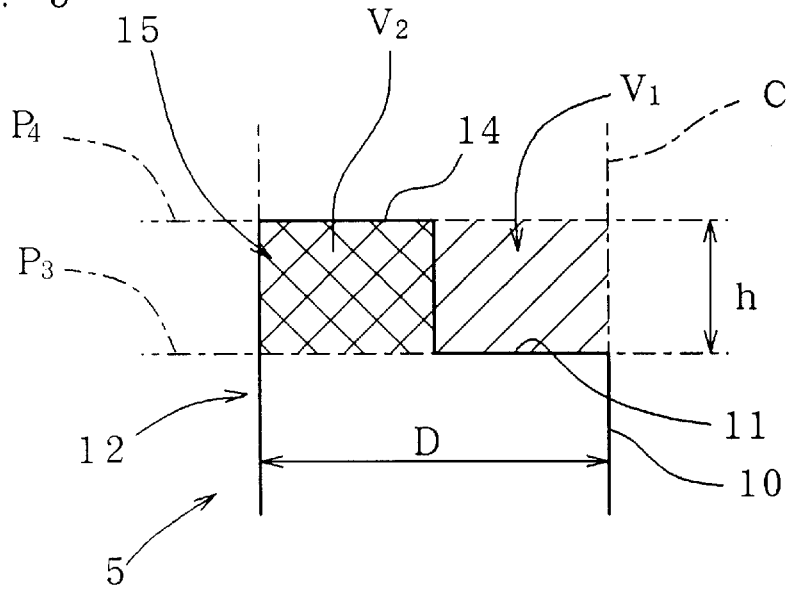
FIG. 5 is an explanatory view of a case in which the protruding portion is formed in the center electrode by a definition by volume ratio.

Further, as shown in FIG. 5, with respect to the center electrode 5, if the volume of a portion surrounded by a plane $P_3$ including the front-end-side opposing face 11 of the body portion 12, a plane $P_4$ including the top face 14 of the protruding portion 15 and an extension C of the cylindrical surface forming the peripheral surface 10 of the body portion 12 is represented $V_1$, and if the volume of the protruding portion 15 is represented as $V_2$, then the value of $V_2/V_1$ is set to not more than 0.8 (desirably not more than 0.5).

In the case where the center electrode 5 and the ground electrode 6 are cut by a plane including the center axis line $O_1$ of the body portion 12 and the center axis line $O_2$ of the ground electrode 6 as shown in FIG. 4B, on the plane, a front end position of an inner edge 201 of the first linear portion $6c_1$, is represented as a point A, a base end position of an inner edge 202 of the second linear portion $6c_2$ is similarly represented as a point B, an intersecting point between a front-end-side extension of the inner edge 201 of the first linear portion $6c_2$, and base-end-side extension of the inner edge 202 of the second linear portion $6c_2$ is represented as a point O, an extension of a front end face 3*e* of the insulator 3 and the inner edge 201, or its extension, of the first linear portion $6c_1$, is represented as a point C, and an intersecting point at which a straight line 204 that passes through an end edge of the front-end-side opposing face 11 on the ground electrode 6 side and perpendicularly crosses the front-end-side opposing face 11 intersects the inner edge 202 of the second linear portion $6c_2$ is represented as a point D, where a triangular region OAB obtained by connecting the point O, the point A and the point B is located inside the triangular region OCD obtained by connecting the point O, the point C and the point D. As apparent also from FIG. 4B, adopting the above constitution makes it possible to further enlarge the space formed beside the center electrode against the ground electrode 6 and moreover to further enhance the ignitability improvement effect of the spark plug.

Furthermore, if a base end position of the first linear portion $6c_1$, is represented as a point E and an intersecting point at which a straight line 203 that passes through an end edge of the front-end-side opposing face 11 farther than the ground electrode 6 and perpendicularly crosses the front-end-side opposing face 11 intersects the inner edge 202, or its extension, of the second linear portion $6c_2$ is represented as a point F, and if the area of a triangular region OAB obtained by connecting the point O, the point A and the point B to one another is $S_{10}$ and the area of a triangular region OEF obtained by connecting the point O, the point E and the point F to one another is $S_{11}$, then the value of $S_{10}/S_{11}$ is in the range of 0.1 to 0.38 (desirably, 0.1 to 0.25). Setting the value of $S_{10}/S_{11}$ to within this range makes it possible to further enlarge the space beside the center electrode against the ground electrode and moreover to further enhance the ignitability improving effect of the spark plug.

Herein below, various modification examples of the spark plug according to the present invention are described.

Figure 8:
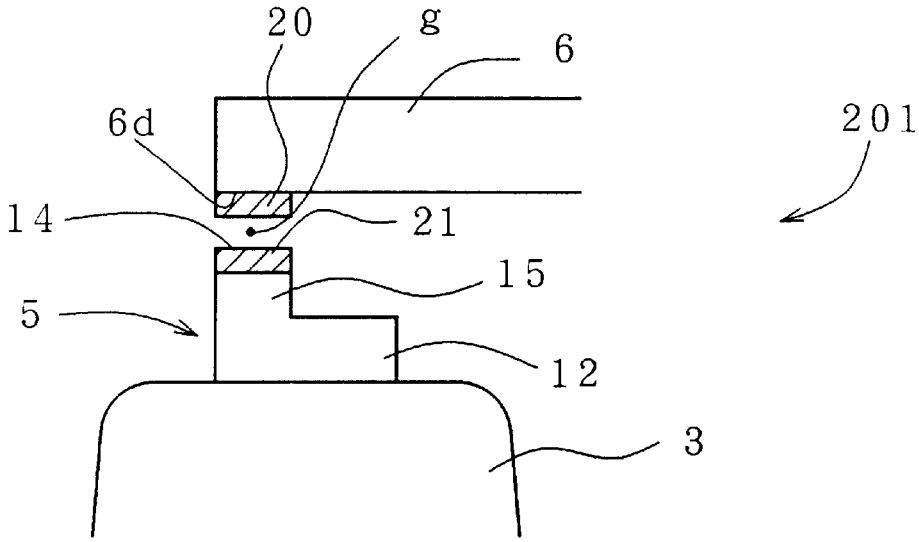
FIG. 8 is a schematic view showing an example of the case where chips are fixed to the center electrode and the ground electrode.

First, referring to a spark plug 201 of FIG. 8, a chip 20 or 21 for forming an igniter may be fixed to either one of the top face 14 of the protruding portion 15 of the center electrode 5 or the side face 6*d* of the ground electrode 6. The chips 20 and 21 are made from a metal, or composite material composed principally of the metal, whose main component is Ru, Rh, Pd, Os, Ir, Pt or the like.

The chip 21 is formed into, for example, a disc shape. While the chip 21 is overlaid on the top face 14 of the protruding portion 15, a welding portion is formed by laser welding, electron beam welding, resistance welding or the like along an outer edge portion of their joint surface, by which the chip 21 is fixed to the protruding portion 15. Also, the chip 20 is aligned with the side face 6*d* of the ground electrode 6 at a position corresponding to the chip 21, where a welding portion is formed in a similar manner along an outer edge portion of their joint surface, by which the chip 21 is fixed. In this way, igniters are formed by fixing such chips 20, 21 as shown above to the protruding portion 15 and the ground electrode 6, by which the consumption (or wear) of the igniters is suppressed so that the durability of the spark plug 201 is improved. In addition, either one of the chips 20, 21 may be omitted. In this case, a spark discharge gap g is formed between the fixed chip and either one of the ground electrode 6 and the protruding portion 15 to whichever no chip is fixed.

Figure 10:
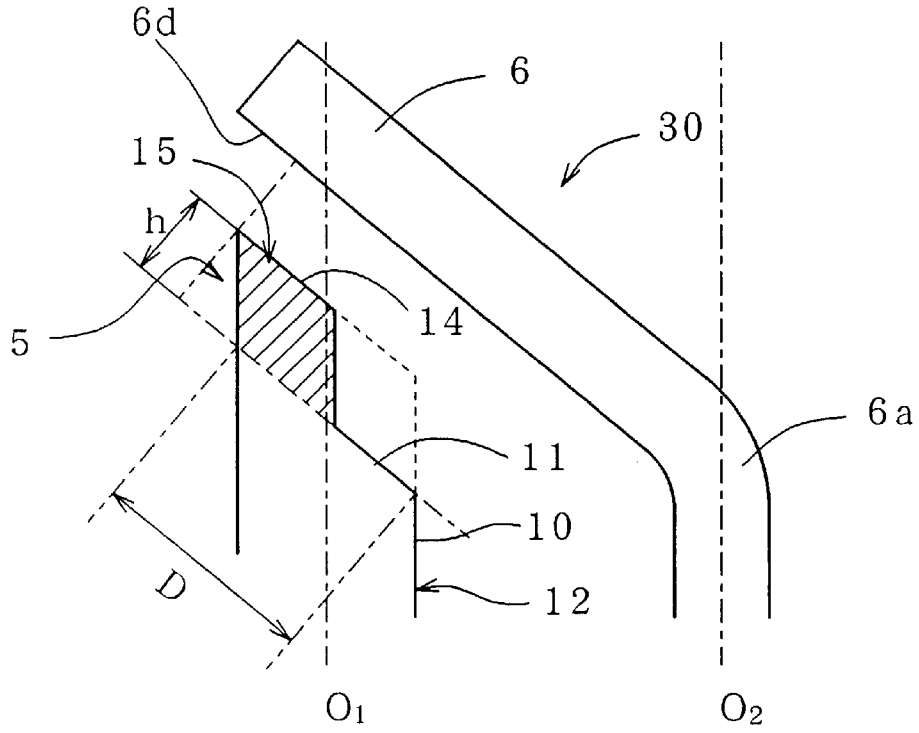
FIG. 10 is a schematic front view showing a modification of the spark plug of FIG. 1.
Figure 11:
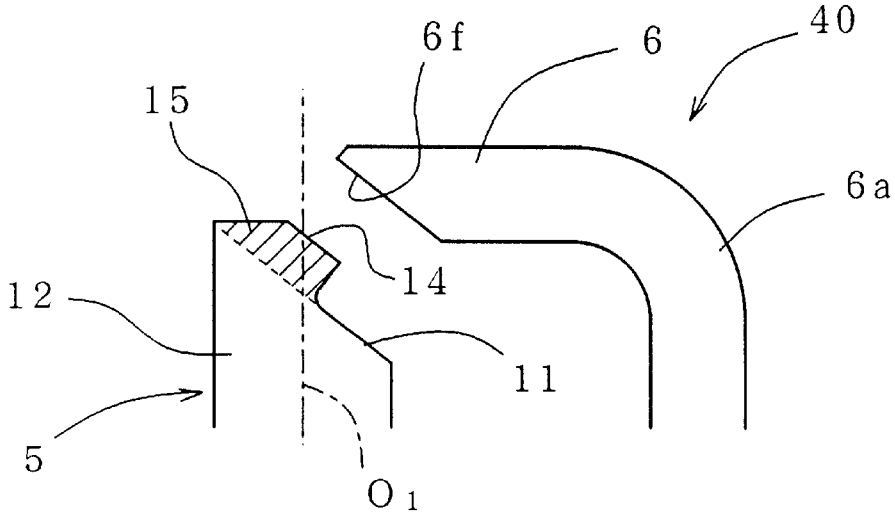
FIG. 11 is a schematic front view showing another modification of the same.

Next, referring to a spark plug 30 shown in FIG. 10, the front-end-side opposing face 11 is formed so as to be inclined with respect to the center axis line $O_1$. The ground electrode 6 is also obliquely folded back correspondingly, where the bending angle is adjusted so that the side face 6*d* of the front end portion becomes generally parallel to the front-end-side opposing face 11. Then, like the spark plug 1 shown in FIG. 1A or FIG. 3, on the front-end-side opposing face 11 of the center electrode 5, is formed a protruding portion 15 at a position decentered toward one side opposite to the ground electrode 6 with respect to the center axis line $O_1$ of the body portion 12 of the center electrode 5, where a top face of the protruding portion 15 is formed into a slope generally parallel to the front-end-side opposing face 11 so as to be generally parallel to the side face 6*d* of the ground electrode 6. In addition, a protruding height h of the protruding portion 15 is defined as a length ranging from the opposing face 11 to the top face 14 in a direction perpendicular to the front-end-side opposing face 11. Also, the front-end-side opposing face 11 and the top face 14 are formed into elliptical surfaces, and the length D of a line segment formed by the intersection of a plane including the center axis lines $O_1$, $O_2$ and the elliptical front-end-side opposing face 11 is corresponding to the length of the major axis of the ellipse. Also, FIG. 11 shows another example in which the front-end-side opposing face 11 of the body portion 12 and the top face 14 of the protruding portion 15 are formed so as to be inclined with respect to the center axis line $O_1$, of the body portion 12. In this spark plug 40, a front end of the ground electrode 6 is folded back so as to be generally perpendicular to the center axis line ol of the body portion 12 of the center electrode 5, while a portion of the ground electrode 6 opposed to the front end portion of the center electrode 5 (a lower side portion of the front end in the figure) is obliquely cut out so that an opposing face 6*f* generally parallel to the top face 14 of the protruding portion 15 is formed.

Figure 12A:
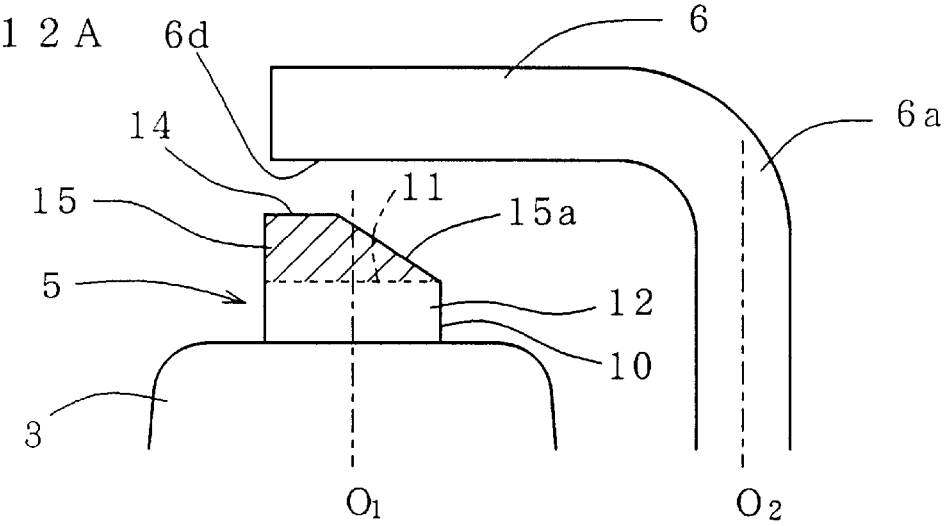
FIG. 12A is a schematic front view showing a first modification of the protruding portion of the center electrode.
Figure 12B:
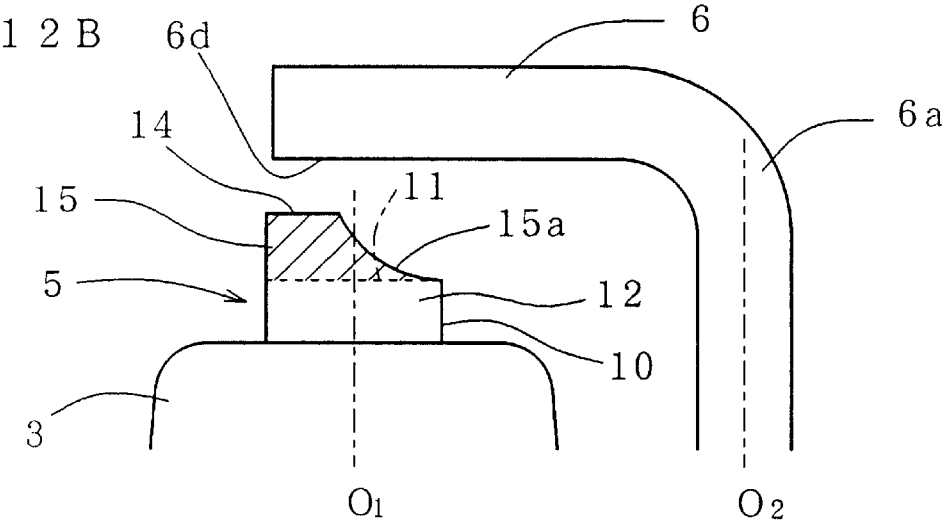
FIG. 12B is a schematic front view showing a second modification of the same.
Figure 12C:
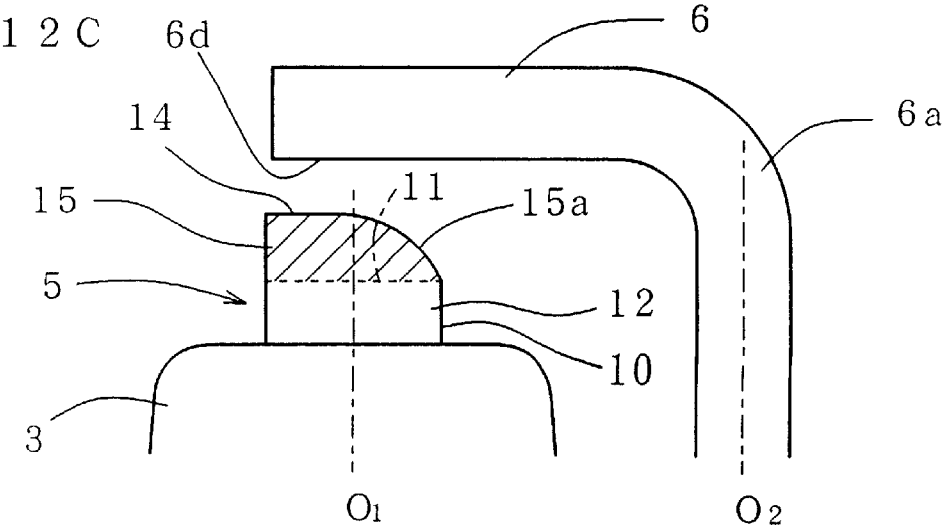
FIG. 12C is a schematic front view showing a third modification of the same.

Next, FIGS. 12A, 12B and 12C show various modifications of the protruding portion 15. Referring to FIG. 12A, the protruding portion 15 is so formed by a slope 15*a* that a side face portion opposite to the ground electrode 6 forms a skirt up to the peripheral edge of the front-end-side opposing face 11 of the body portion 12. Also, FIG. 12B shows an example in which the slope 15*a* is a downwardly convex curved surface 15*a*, while FIG. 12C similarly shows an example in which the protruding portion 15 is a upwardly convex curved surface. In such a case, the front-end-side opposing face 11 of the body portion 12 can be defined as a cross section of the center electrode 5 that passes through an edge of the slope 15*a* on a side opposite to the top face 14 in the direction of the center axis line $O_1$ of the body portion 12 and crosses the center axis line $O_1$, and that is cut by a plane parallel to the opposing side face 6*d* of the ground electrode 6.

Figure 9A:
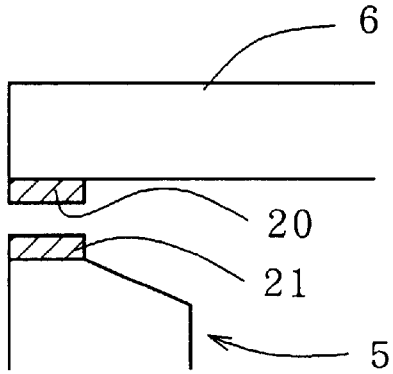
FIG. 9A is a schematic view showing a first modification of the same.
Figure 9B:
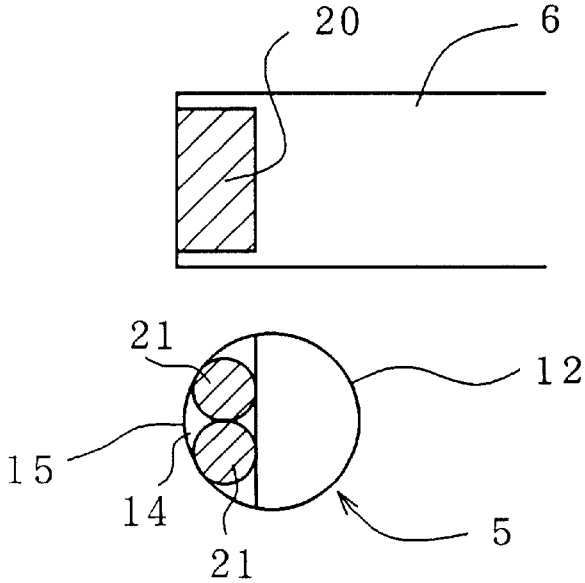
FIG. 9B is a schematic view showing a second modification of the same.
Figure 13:
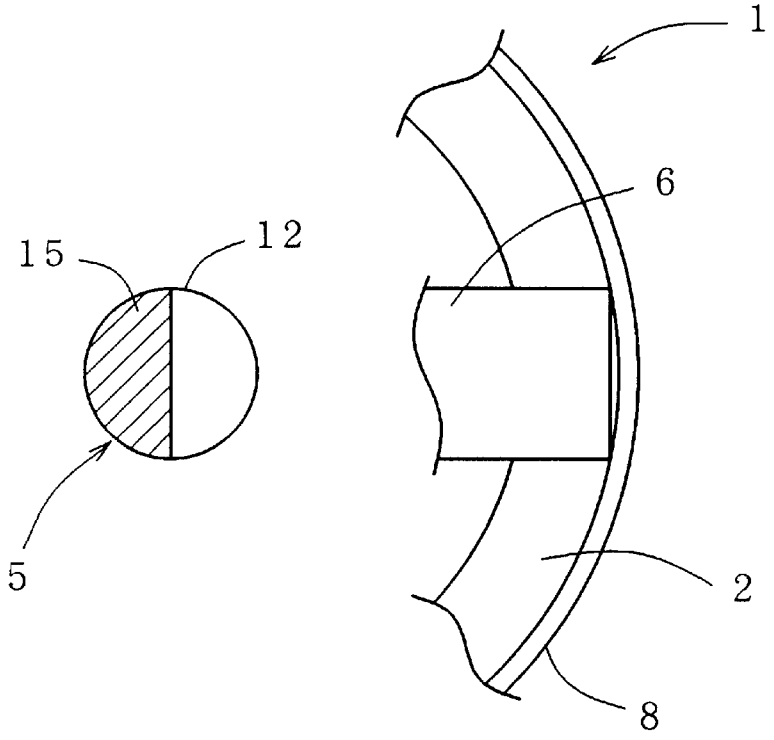
FIG. 13 is a schematic plan view showing a modification of the top face of the protruding portion.

In addition, in the above embodiments, the top face 14 of the protruding portion 15 has been formed into a circular shape. However, the top face 14 may be formed into a semicircular shape as shown in FIG. 13. In this case, as shown in FIGS. 9A and 9B, two disc-shaped chips 21 may be fixed widthwise to the top face 14. Besides, a wide chip 20 corresponding to juxtaposed chips 21 may be fixed to the side face 6*d* of the ground electrode 6.

Figure 7:
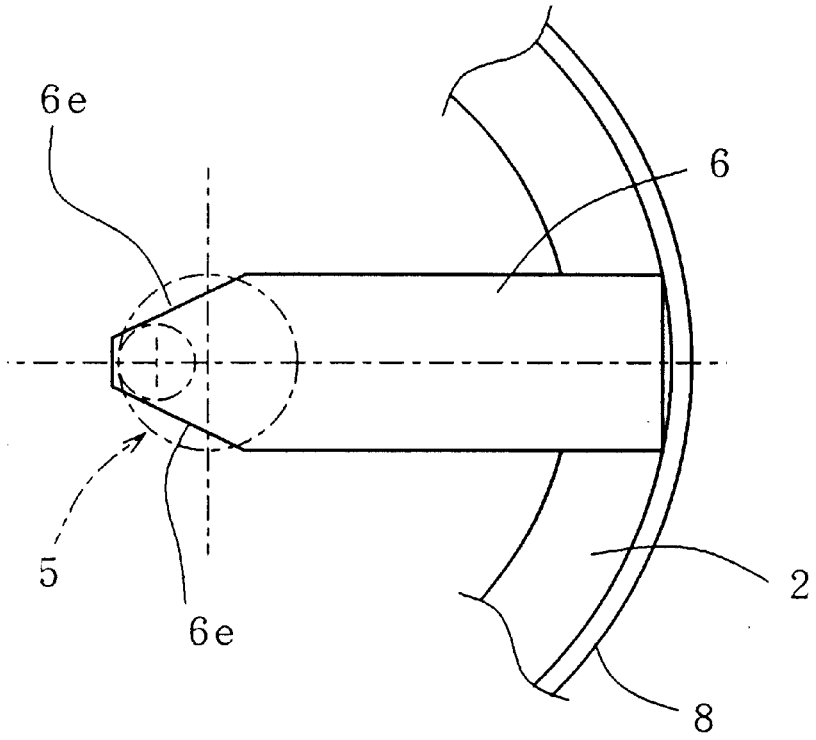
FIG. 7 is an enlarged plan view of the spark plug.
Figure 14A:
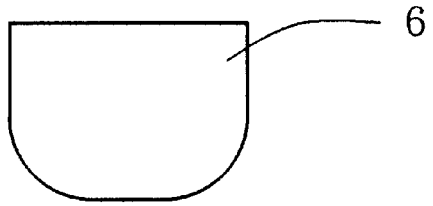
FIG. 14A is a schematic view showing a first modification of the axial cross-sectional shape of the ground electrode.
Figure 14B:
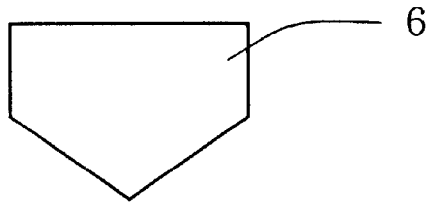
FIG. 14B is a schematic view showing a second modification of the same.
Figure 14C:
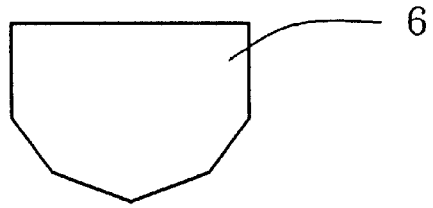
FIG. 14C is a schematic view showing a third modification of the same.
Figure 14D:
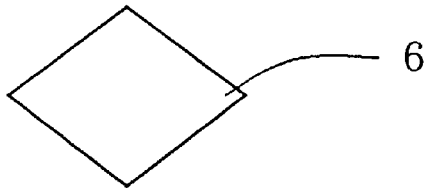
FIG. 14D is a schematic view showing a fourth modification of the same.

Also, the axial cross-sectional shape of the ground electrode 6 is not limited to trapezoidal shape, and may be of any other shape whatever it is reduced more in width on one side opposing to the center electrode 5 than in its opposite side. The shape may be selected from various shapes, such as an inverted semicircular shape as shown in FIG. 14A, a pentagonal shape (or baseball's home-plate like shape) as shown in FIG. 14B, and some other polygonal shape as shown in FIG. 14C. Further, the axial cross-sectional shape of the ground electrode 6 may be formed into a rhombic shape as shown in FIG. 14D. In addition, the ground electrode 6 may be formed into one having a rectangular cross section or a circular cross section as is usual. Besides, the front end portion of the ground electrode 6 may also be formed in another way such as a triangular shape or semicircular shape without being limited to the trapezoidal shape as shown in FIG. 7.

EXAMPLES

Example 1

Figure 6:
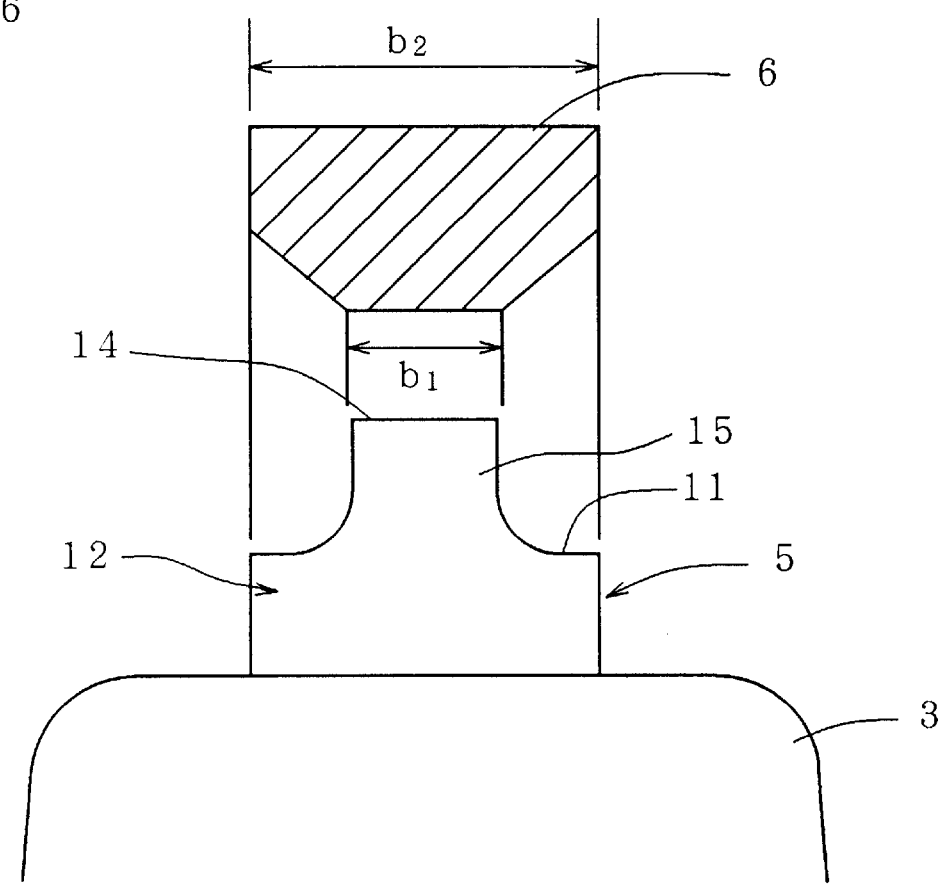
FIG. 6 is a partly enlarged side view of the spark plug.
Figure 16:
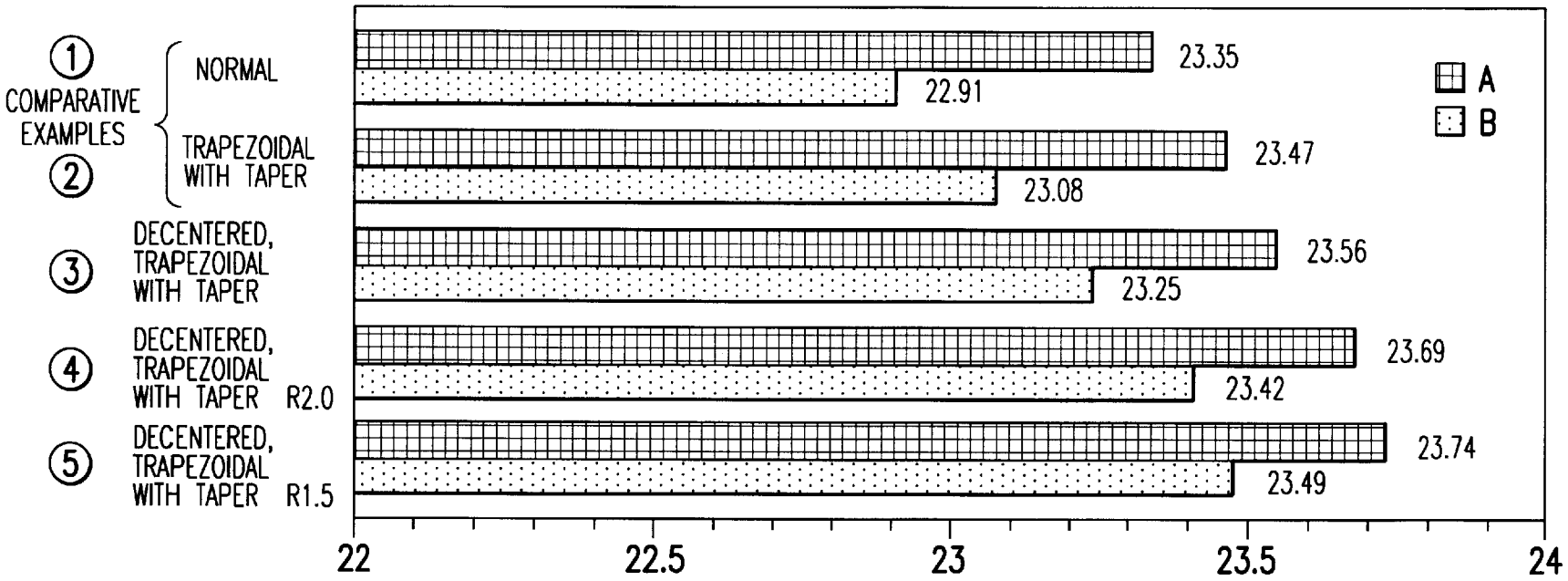
FIG. 16 is a graph showing experiment results in Examples.
Figure 17:
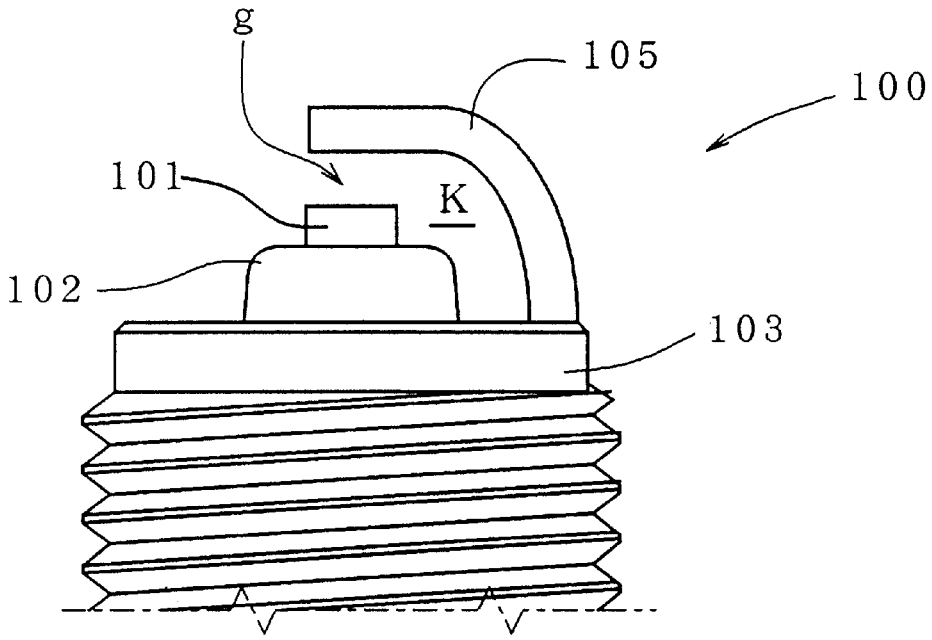
FIG. 17 is a partial front view showing a spark plug according to the prior art.

The spark plug shown in FIGS. 1A and 1B was made in various aspects of ③–⑤ shown in FIG. 16. In each of the spark plugs of ③–⑤, the outer diameter (corresponding to D as described above, see FIG. 3) of the body portion 12 of the center electrode 5 was 2.6 mm, outer diameter and height of the protruding portion 15 were 0.8 mm and 1.2 mm, respectively, the spark gap g was 1.1 mm, and the body portion 12 and the protruding portion 15 were cylindrical shaped, respectively (FIGS. 1A and 1B). Also, the body portion 12 was so formed so as to be decentered on the front-end-side opposing face 11 of the body portion 12 so that the aforementioned value of $S_1/S_2$ would be 1.0 and the value of $V_2/V_1$ would be 0.1, where the value of h/D was about 0.46. The ground electrode 6 was formed into a trapezoidal shape having widths of its axial cross section b1=1.6 mm and b2=2.7 mm (FIG. 6), where a trapezoidal reduced-width portion 6*e* was formed at the front end portion of the ground electrode 6. Further, whereas the mean radius of curvature of the inner edge portion of the bent portion 6*a* of the ground electrode 6 has been set to R6.0 mm in the case of ③, it was set to R2.0 mm in the case of ④ and R1.5 mm in the case of ⑤. The value of $S_{10}/S_{11}$ was 0.16 for 3, 0.16 for 4, and 0.1 for ⑤. Meanwhile, as comparative examples, a conventional type spark plug (①) which has a ground electrode of a rectangular axial cross section and in which the protruding portion 15 is not decentered, and a spark plug (②) in which the axial cross section of the ground electrode 6 was formed as in the foregoing spark plugs of ③–⑤ and the protruding portion 15 is not decentered were made with the mean radius of curvature of the inner edge portion of the bent portion 6*a* set to R6.0 mm (where $S_{10}/S_{11}$, was 0.16).

Figure 15A:
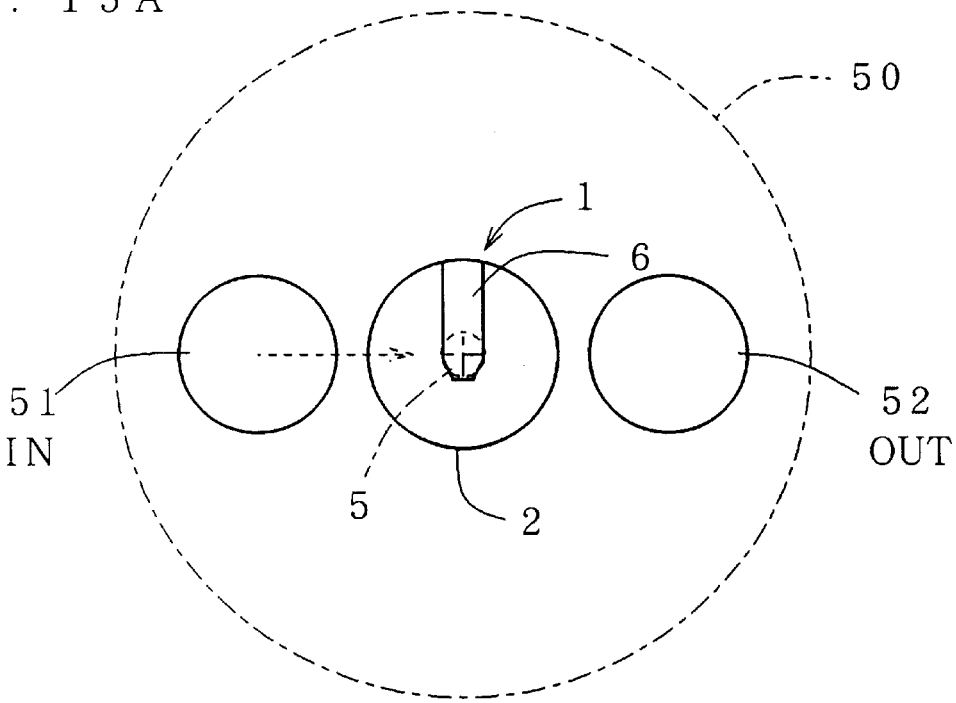
FIG. 15A is a first explanatory view showing the fitting position of the spark plug in Examples.
Figure 15B:
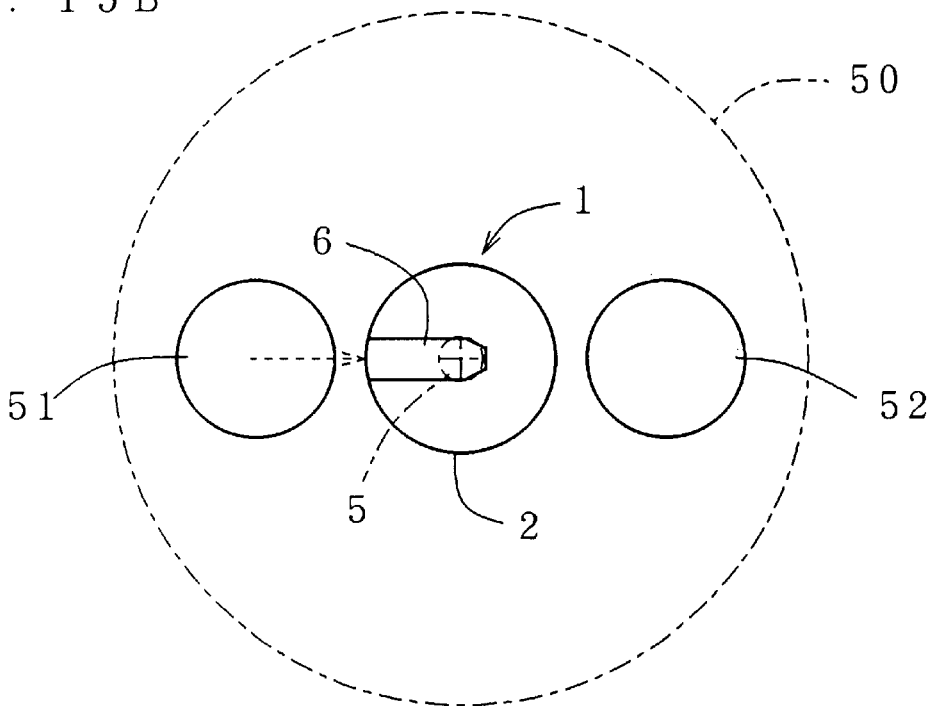
FIG. 15B is a second explanatory view showing the fitting position of the spark plug in Examples.

Each of these spark plugs was mounted to a cylinder head of a DOHC gasoline engine having a displacement volume of 2000 cc, where the engine speed was set 2000 rpm and the pressure in the intake manifold was set to −350 mmHg in gauge pressure. Then, under the operation in which the air-to-fuel ratio was being gradually increased toward the lean side, the ignitability was determined by the air-to-fuel ratio resulting when the operation was disabled. In addition, as the direction in which the spark plug was fitted to the cylinder head 50, were selected two types of directions, i.e., one direction in which the ground electrode 6 was generally perpendicular to a line formed by connecting an inlet valve 51 and an exhaust valve 52 to each other as shown in FIG. 15A (A: a direction of relatively good ignitability), and the other direction in which the ground electrode 6 is generally parallel to a line formed by connecting the inlet valve 51 and the exhaust valve 52 to each other and in which the inlet valve 51 is so positioned as to be positioned on a side opposite to the center electrode 5 with respect to the ground electrode 6 (B: a direction of relatively poor ignitability).

From experimental results shown in FIG. 16, it can be understood that the spark plug ③ according of the present invention is larger in value of the air-to-fuel ratio that disables the operation, and therefore better in ignitability, than the spark plugs ① and ③ of the comparative examples, regardless of the direction in which the spark plug is fitted to the engine. It can also be seen that the ignitability is further improved with reduced mean radius of curvature of the inner edge portion of the bent portion 6*a* of the ground electrode 6, as shown in the results of ④ and ⑤. Further, the spark plugs ③–⑤ of the present invention show smaller differences in ignitability between the fitting direction A and the fitting direction B, thus less affected by the fitting direction, as compared with the spark plugs ① and ② of the comparative examples.

What is claimed is:

1. The spark plug comprising: a center electrode; an insulator provided outside the center electrode; a metallic shell provided outside the insulator; and a ground electrode which is so arranged that one end is coupled to the metallic shell and the other end is folded back sideways so as to be opposed to the center electrode so that a side face of the ground electrode is opposed to a front end portion of the center electrode, wherein the center electrode comprises a body portion having a cylindrical peripheral surface and a front-end-side opposing face opposed and generally parallel to the side face of the ground electrode and a protruding portion which protrudes from the front-end-side opposing face at the position off-center with respect to a center axis line of the body portion toward one side opposite to the ground electrode and which has a top face formed generally parallel to the side face of the ground electrode, wherein given a length D of a line segment formed by an intersection that a plane including the center axis line of the body portion and a center axis line of the ground electrode intersects the front-end-side opposing face, and a protruding height h to which the protruding portion protrudes from the front-end-side opposing face, a value of h/D is not less than 0.2.

2. The spark plug according to claim 1, wherein on condition that a plane $P_2$ that intersects a plane $P_1$ including the center axis line of the body portion and the center axis line of the ground electrode is set so that an intersecting line coincides with the center axis line of the body portion, and that a region farther from the ground electrode out of two regions of the front-end-side opposing face divided by the plane is represented as a reference region, when the top face of the protruding portion and the front-end-side opposing face are viewed in a direction perpendicular to these surfaces, an area of a portion overlapping between the top face and the reference region is represented as $S_1$ and an area of the top face is represented as $S_2$, then a value of $S_1/S_2$ is set not less than 0.7.

3. The spark plug according to claim 1, wherein an axial cross section of the ground electrode is so shaped as to be reduced in width on a side facing the center electrode more than on its opposite side.

4. The spark plug according to claim 1, wherein the ground electrode has a reduced-width portion formed in a range from a specified intermediate position in its longitudinal direction, the reduced-width portion being reduced in width on a base end side of the ground electrode more than on its front end side.

5. The spark plug according to claim 1, wherein the ground electrode comprises: a first linear portion formed on the base end side so as to be generally parallel to the center axis line of the body portion of the center electrode; a second linear portion formed on the front end side so as to be generally parallel to the front-end-side opposing face of the center electrode; and a bent portion with which those first and second linear portions are connected to each other, wherein when the center electrode and the ground electrode are cut by a plane including the center axis line of the body portion and the center axis line of the ground electrode, wherein, on the plane, a front end position of an inner edge of the first linear portion is represented as a point A, wherein a base end position of an inner edge of the second linear portion is similarly represented as a point B, wherein an intersecting point between a front-end-side extension of the inner edge of the first linear portion and a base-end-side extension of the inner edge of the second linear portion is represented as a point O, wherein an extension of a front end face of the insulator and the inner edge, or its extension, of the first linear portion is represented as a point C, and wherein an intersecting point at which a straight line that passes through an end edge of the front-end-side opposing face on the ground electrode side and perpendicularly crosses the front-end-side opposing face intersects the inner edge of the second linear portion is represented as a point D, a triangular region OAB obtained by connecting the point O, the point A and the point B to one another is located inside a triangular region OCD obtained by connecting the point O, the point C and the point D to one another.

6. The spark plug according to claim 1, wherein the ground electrode comprises: a first linear portion formed on the base end side so as to be generally parallel to the center axis line of the body portion of the center electrode; a second linear portion formed on the front end side so as to be generally parallel to the front-end-side opposing face of the center electrode; and a bent portion with which those first and second linear portions are connected to each other, wherein when the center electrode and the ground electrode are cut by a plane including the center axis line of the body portion and the center axis line of the ground electrode, wherein on the plane, a front end position of an inner edge of the first linear portion is represented as a point A, wherein a base end position of an inner edge of the second linear portion is similarly represented as a point B, wherein an intersecting point between a front-end-side extension of the inner edge of the first linear portion and a base-end-side extension of the inner edge of the second linear portion is represented as a point O, wherein a base end position of the first linear portion is represented as a point E, and wherein an intersecting point at which a straight line that passes through an end edge of the front-end-side opposing face farther from the ground electrode and perpendicularly crosses the front-end-side opposing face intersects the inner edge, or its extension, of the second linear portion is represented as a point F, if an area of a triangular region OAB obtained by connecting the point O, the point A and the point B to one another is $S_{10}$ and an area of a triangular region OEF obtained by connecting the point O, the point E and the point F to one another is $S_{11}$, then a value of $S_{10}/S_{11}$, is in the range of 0.1 to 0.38.

7. The spark plug according to claim 1, wherein a chip made from metal, or composite material composed principally of metal, whose main component is at least any one of Ru, Rh, Pd, Os, Ir and Pt is fixed to at least one of the top face of the protruding portion of the center electrode and the side face of the ground electrode.

8. A spark plug comprising: a center electrode; an insulator provided outside the center electrode; a metallic shell provided outside the insulator; and a ground electrode which is so arranged that one end is coupled to the metallic shell and the other end is folded back sideways so as to be opposed to the center electrode so that a side face of the ground electrode is opposed to a front end portion of the center electrode, wherein the center electrode comprises a body portion having a cylindrical peripheral surface and a front-end-side opposing face opposed and generally parallel to the side face of the ground electrode and a protruding portion which protrudes from the front-end-side opposing face at the position off-center with respect to a center axis line of the body portion toward one side opposite to the ground electrode and which has a top face formed generally parallel to the side face of the ground electrode, wherein given a volume $V_1$ of a portion surrounded by a plane including the front-end-side opposing face of the body portion, a plane including a top face of the protruding portion, and an extension of the peripheral surface of the front-end-side opposing face toward the protruding portion, and a volume $V_2$ of the protruding portion, a value of $V_2/V_1$ is not more than 0.8.

9. The spark plug according to claim 8, wherein given a length D of a line segment formed by an intersection that a plane including the center axis line of the body portion and a center axis line of the ground electrode intersects the front-end-side opposing face, and a protruding height h to which the protruding portion protrudes from the front-end-side opposing face, a value of h/D is not less than 0.2.

10. The spark plug according to claim 8, wherein on condition that a plane $P_2$ that intersects a plane $P_1$ including the center axis line of the body portion and the center axis line of the ground electrode is set so that an intersecting line coincides with the center axis line of the body portion, and that a region farther from the ground electrode out of two regions of the front-end-side opposing face divided by the plane is represented as a reference region, when the top face of the protruding portion and the front-end-side opposing face are viewed in a direction perpendicular to these surfaces, an area of a portion overlapping between the top face and the reference region is represented as $S_1$ and an area of the top face is represented as $S_2$, then a value of $S_{1/S2}$ is set not less than 0.7.

11. The spark plug according to claim 8, wherein an axial cross section of the ground electrode is so shaped as to be reduced in width on a side facing the center electrode more than on its opposite side.

12. The spark plug according to claim 8, wherein the ground electrode has a reduced-width portion formed in a range from a specified intermediate position in its longitudinal direction, the reduced-width portion being reduced in width on a base end side of the ground electrode more than on its front end side.

13. The spark plug according to claim 8, wherein the ground electrode comprises: a first linear portion formed on the base end side so as to be generally parallel to the center axis line of the body portion of the center electrode; a second linear portion formed on the front end side so as to be generally parallel to the front-end-side opposing face of the center electrode; and a bent portion with which those first and second linear portions are connected to each other, in a case where the center electrode and the ground electrode are cut by a plane including the center axis line of the body portion and the center axis line of the ground electrode, wherein on the plane, a front end position of an inner edge of the first linear portion is represented as a point A, wherein a base end position of an inner edge of the second linear portion is similarly represented as a point B, wherein an intersecting point between a front-end-side extension of the inner edge of the first linear portion and a base-end-side extension of the inner edge of the second linear portion is represented as a point O, wherein an extension of a front end face of the insulator and the inner edge, or its extension, of the first linear portion is represented as a point C, and wherein an intersecting point at which a straight line that passes through an end edge of the front-end-side opposing face on the ground electrode side and perpendicularly crosses the front-end-side opposing face intersects the inner edge of the second linear portion is represented as a point D, a triangular region OAB obtained by connecting the point O, the point A and the point B to one another is located inside a triangular region OCD obtained by connecting the point O, the point C and the point D to one another.

14. The spark plug according to claim 8, wherein the ground electrode comprises: a first linear portion formed on the base end side so as to be generally parallel to the center axis line of the body portion of the center electrode; a second linear portion formed on the front end side so as to be generally parallel to the front-end-side opposing face of the center electrode; and a bent portion with which those first and second linear portions are connected to each other, in a case where the center electrode and the ground electrode are cut by a plane including the center axis line of the body portion and the center axis line of the ground electrode, wherein on the plane, a front end position of an inner edge of the first linear portion is represented as a point A, wherein a base end position of an inner edge of the second linear portion is similarly represented as a point B, wherein an intersecting point between a front-end-side extension of the inner edge of the first linear portion and a base-end-side extension of the inner edge of the second linear portion is represented as a point O, wherein a base end position of the first linear portion is represented as a point E, and wherein an intersecting point at which a straight line that passes through an end edge of the front-end-side opposing face farther from the ground electrode and perpendicularly crosses the front-end-side opposing face intersects the inner edge, or its extension, of the second linear portion is represented as a point F, if an area of a triangular region OAB obtained by connecting the point O, the point A and the point B to one another is $S_{10}$ and an area of a triangular region OEF obtained by connecting the point O, the point E and the point F to one another is $S_{11}$, then a value of $S_{10}/S_{11}$, is in the range of 0.1 to 0.38.

15. The spark plug according to claim 9, wherein a chip made from metal, or composite material composed principally of metal, whose main component is at least any one of Ru, Rh, Pd, Os, Ir and Pt is fixed to at least one of the top face of the protruding portion (15) of the center electrode and the side face of the ground electrode.

16. The spark plug comprising: a center electrode; an insulator provided outside the center electrode; a metallic shell provided outside the insulator; and a ground electrode which is so arranged that one end is coupled to the metallic shell and the other end is folded back sideways so as to be opposed to the center electrode so that a side face of the ground electrode is opposed to a front end portion of the center electrode, wherein the center electrode comprises a body portion having a cylindrical peripheral surface and a front-end-side opposing face opposed and generally parallel to the side face of the ground electrode and a protruding portion which protrudes from the front-end-side opposing face at the position off-center with respect to a center axis line of the body portion toward one side opposite to the ground electrode and which has a top face formed generally parallel to the side face of the ground electrode, wherein the protruding portion is cylindrically formed.

17. The spark plug according to claim 16, wherein given a length D of a line segment formed by an intersection of a plane including the center axis line of the body portion and a center axis line of the ground electrode intersects the front-end-side opposing face, and a protruding height h to which the protruding portion protrudes from the front-end-side opposing face, a value of h/D is not less than 0.2.

18. The spark plug according to claim 17, wherein a chip made from a metal, or composite material composed principally of the metal, whose main component is at least any one of Ru, Rh, Pd, Os, Ir and Pt is fixed to either one of the top face of the protruding portion of the center electrode or the side face of the ground electrode.

19. A spark plug comprising: a center electrode; an insulator provided outside the center electrode; a metallic shell provided outside the insulator; and a ground electrode which is so arranged that one end is coupled to the metallic shell and the other end is folded back sideways so as to be opposed to the center electrode so that a side face of the ground electrode is opposed to a front end portion of the center electrode, wherein the center electrode comprises a body portion having a cylindrical peripheral surface and a front-end-side opposing face opposed and generally parallel to the side face of the ground electrode' and a protruding portion which protrudes from the front-end-side opposing face at the position off-center with respect to a center axis line of the body portion toward one side opposite to the ground electrode and which has a top face formed generally plane-parallel to the side face of the ground electrode.

20. The spark plug according to claim 19 wherein on condition that a plane $P_2$ that intersects a plane $P_1$ , including the center axis line of the body portion and the center axis line of the ground electrode is set so that an intersecting line coincides with the center axis line of the body portion, and that a region farther from the ground electrode out of two regions of the front-end-side opposing face divided by the plane is represented as a reference region, when the top face of the protruding portion and the front-end-side opposing face are viewed in a direction perpendicular to these surfaces, an area of a portion overlapping between the top face and the reference region is represented as $S_1$ and an area of the top face is represented as $S_2$ then a value of $S_1/S_2$ is set not less than 0.7.

21. The spark plug according to claim 20, wherein an axial cross section of the ground electrode is so shaped as to be reduced in width on a side facing the center electrode more than on its opposite side.

22. The spark plug according to claim 20, wherein the ground electrode has a reduced-width portion formed in a range from a specified intermediate position in its longitudinal direction, the reduced-width portion being reduced in width on a base end side of the ground electrode more than on its front end side.

23. The spark plug according to claim 20, wherein the ground electrode comprises: a first linear portion formed on the base end side so as to be generally parallel to the center axis line of the body portion of the center electrode; a second linear portion formed on the front end side so as to be generally parallel to the front-end-side opposing face of the center electrode; and a bent portion with which those first and second linear portions are connected to each other, wherein when the center electrode and the ground electrode are cut by a plane including the center axis line of the body portion and the center axis line of the ground electrode, wherein, on the plane, a front end position of an inner edge of the first linear portion is represented as a point A, wherein a base end position of an inner edge of the second linear portion is similarly represented as a point B, wherein an intersecting point between a front-end-side extension of the inner edge of the first linear portion and a base-end-side extension of the inner edge of the second linear portion is represented as a point O, wherein an extension of a front end face of the insulator and the inner edge, or its extension, of the first linear portion is represented as a point C, and wherein an intersecting point at which a straight line that passes through an end edge of the front-end-side opposing face on the ground electrode side and perpendicularly crosses the front-end-side opposing face intersects the inner edge of the second linear portion is represented as a point D, a triangular region OAB obtained by connecting the point, the point A and the point B to one another is located inside a triangular region OCD obtained by connecting the point O, the point C and the point D to one another.

24. The spark plug according to claim 20, wherein the ground electrode comprises: a first linear portion formed on the base end side so as to be generally parallel to the center axis line of the body portion of the center electrode; a second linear portion formed on the front end side so as to be generally parallel to the front-end-side opposing face of the center electrode; and a bent portion with which those first and second linear portions are connected to each other, wherein when the center electrode and the ground electrode are cut by a plane including the center axis line of the body portion and the center axis line of the ground electrode, wherein on the plane, a front end position of an inner edge of the first linear portion is represented as a point A, wherein a base end position of an inner edge of the second linear portion is similarly represented as a point B, wherein an intersecting point between a front-end-side extension of the inner edge of the first linear portion and a base-end-side extension of the inner edge of the second linear portion is represented as a point O, wherein a base end position of the first linear portion is represented as a point E, and wherein an intersecting point at which a straight line that passes through an end edge of the front-end-side opposing face farther from the ground electrode and perpendicularly crosses the front-end-side opposing face intersects the inner edge, or its extension, of the second linear portion is represented as a point F, if an area of a triangular region OAB obtained by connecting the point O, the point A and the point B to one another is $S_{10}$ and an area of a triangular region OEF obtained by connecting the point O, the point E and the point F to one another is $S_{11}$, then a value of $S_{10}/S_{11}$ is in the range of 0.1 to 0.38.

25. The spark plug according to claim 20, wherein a chip made from metal, or composite material composed principally of metal, whose main component is at least any one of Ru, Rh, Pd, Os, Ir and Pt is fixed to at least one of the top face of the protruding portion of the center electrode and the side face of the ground electrode.

26. The spark plug according to claim 20, wherein the protruding portion is cylindrically formed.

27. The spark plug according to claim 26, wherein a chip made from a metal, or composite material composed principally of the metal, whose main component is at least any one of Ru, Rh, Pd, Os, Ir and Pt is fixed to either one of the top face of the protruding portion of the center electrode or the side face of the ground electrode.

* * * * *